United States Patent [19]

Fukuda et al.

[11] Patent Number: 4,656,390

[45] Date of Patent: Apr. 7, 1987

[54] COLOR PICTURE TUBE DEVICE

[75] Inventors: Kumio Fukuda, Fukaya; Taketoshi Shimoma, Isesaki, both of Japan

[73] Assignee: Kabushiki Kaisha Toshiba, Kawasaki, Japan

[21] Appl. No.: 731,903

[22] Filed: May 8, 1985

[30] Foreign Application Priority Data

May 10, 1984 [JP] Japan ..... 59-91792
Nov. 21, 1984 [JP] Japan ..... 59-244613

[51] Int. Cl.[4] ..... H01J 29/51
[52] U.S. Cl. ..... 313/409; 313/413
[58] Field of Search ..... 313/413, 414, 431, 437

[56] References Cited

U.S. PATENT DOCUMENTS

| | | | |
|---|---|---|---|
| Re. 29,895 | 1/1979 | Murata et al. | 313/411 |
| 3,860,850 | 1/1975 | Takenaka et al. | 313/431 |
| 4,142,131 | 2/1979 | Ando et al. . | |
| 4,196,370 | 4/1980 | Hughes | 313/413 |
| 4,225,804 | 9/1980 | Bekaert et al. | 313/412 |
| 4,415,831 | 11/1983 | Konosu | 313/413 |
| 4,547,698 | 10/1985 | Gioia et al. | 313/414 |
| 4,556,819 | 12/1985 | Chen et al. | 313/413 |

FOREIGN PATENT DOCUMENTS

| | | | |
|---|---|---|---|
| 109717 | 5/1984 | European Pat. Off. | 313/437 |
| 2545718 | 10/1975 | Fed. Rep. of Germany . | |
| 26-44046 | 11/1951 | Japan . | |
| 58-7017 | 2/1983 | Japan . | |
| 58-45135 | 10/1983 | Japan . | |

OTHER PUBLICATIONS

Patents Abstracts of Japan, JP-B-58 007 017, FIGS. 2, 4, 8, 10.

*Primary Examiner*—Stewart J. Levy
*Assistant Examiner*—Hezron E. Williams
*Attorney, Agent, or Firm*—Cushman, Darby & Cushman

[57] ABSTRACT

In an in-line type color picture tube device, a deflection yoke is arranged around the neck and funnel sections and the deflection yoke comprises saddle coils for generating a horizontal deflection magnetic field and troidal coil for generating a vertical deflection magnetic field. First and second annular magnetic field control elements of a magnetic material with a high permeability are located between the deflection yoke and the cathodes of an electron gun assembly to surround the beam paths of center and side beams emitted from the cathodes. The second element is arranged closer to the cathode than the first elements.

8 Claims, 12 Drawing Figures

COLOR PICTURE TUBE DEVICE

BACKGROUND OF THE INVENTION

The present invention relates to a color picture tube device and, more particularly, to a color picture tube device with an electron gun assembly for generating three electron beams.

In a conventional in-line type color picture tube device, three electron beams, e.g., R, G and B beams are generated from an electron gun assembly received in a neck section of a tube envelope. These electron beams are so converged as to obtain an optimal raster size at a panel section as a screen of the tube envelope. The electron beams are deflected by a deflection magnetic field produced by a deflection yoke which is located around the neck and funnel sections of the tube envelope and which comprises saddle type coils for generating a horizontal deflection magnetic field and a taroidal coil mounted around an annular magnetic permeable core in a taroidal manner so as to generate a vertical deflection magnetic field. The screen is scanned with the deflected electron beams.

In a self convergence type color picture tube, a horizontal deflection magnetic field is formed in a pin cushion shape, and a vertical deflection magnetic field is formed in a barrel shape. The three electron beams are converged on the entire region of the substantially rectangular screen, thereby sufficiently minimizing convergence errors. Methods for minimizing convergence error to improve image quality is disclosed in Japanese Patent Publications Nos. 58-45135 and 51-44046. A magnetic field control element of a high permeability magnetic material is located at a proper position between the deflection yoke and the electron gun assembly to shunt or enhance the magnetic field leaked from the deflection yoke, thereby equalizing the raster size traced by the center electron beam with that of the side electron beams. Furthermore, in Japanese Patent Publication No. 58-7017, two types of magnetic shunt elements are located at different planes along the axis of the envelope to increase a margin for correcting coma along the horizontal and vertical axes, thereby setting the coma along the horizontal and vertical axes within predetermined values.

However, in a color picture tube using the conventional magnetic field control element, the following drawback is presented. Most conventional color picture tubes employ a self convergence system wherein R, G and B electron beams are converged on the display screen. According to this system, electron beam convergence is performed by utilizing aberration components of the deflection magnetic field itself. Therefore, the horizontal deflection magnetic field must have a pin cushion shape, and the vertical deflection magnetic field must have a barrel shape. In addition, the magnetic field control element located at the top of the electron gun assembly received in a neck acts on the magnetic field leaked from the deflection yoke so as to converge a center beam and side beams on the screen.

The convergence of the center beam and the side beams is greatly degraded at corners of the screen.

FIG. 1 shows a screen wherein the scanning lines of the center beam of the screen are not coincident with these of the side beams 5R and 5B at corners of the screen. Referring to FIG. 1, the solid lines represent the scanning lines of side beams, and the broken lines represent the scanning lines of center beam. The above-mentioned magnetic control element is generally designed to align the beams at top and bottom center points a and right and left center points b.

As shown in FIG. 1, the scanning lines of the center beam are shifted, as compared with these of the side beams, depending on the distance from the V axis to the scanning position of the center beam along the horizontal axis, thereby increasing convergence errors at the corners of the screen and hence degradation of the image quality. This degradation is unacceptable in a high-resolution character display. In addition, when the screen size and the deflection angle are increased, the above-mentioned convergence errors are increased.

At an intermediate point al along the V axis, the scanning point of the center beam is deviated outside the side beams. In this manner, even at the central portion of the screen, convergence is degraded.

In a conventional magnetic shunt element having a shape and arrangement as shown in FIG. 8 of Japanese Patent Publication No. 58-7017, the first magnetic shunt element at the cathode side acts to increase deflection sensitivity of the center beam with respect to the vertical or V axis. However, the second magnetic shunt element decreases deflection sensitivity of the center beam. Even in a color picture tube having the arrangement described above, the scanning lines of the center beam are shifted from these of the corresponding side beams near the corners of the screen.

SUMMARY OF THE INVENTION

It is an object of the present invention to obtain good image quality and high-resolution character quality by preventing noncoincidence between the side beam rasters and the center beam raster.

According to the present invention, there is provided a color picture tube having first and second magnetic field control elements which are spaced apart from each other by a predetermined distance along a beam propagation direction between a cathode and a deflection yoke and which are housed in a neck, the first magnetic control element being located at a deflection yoke side and being arranged to relatively increase a center beam raster in at least a direction perpendicular to a plane determined by three beams, the second magnetic control element being located at a cathode side and being arranged to increase side beam rasters relative to the center beam raster, and the first and second magnetic field control elements cooperating to align the center beam rasters with the side beam rasters. Therefore, unlike the conventional color picture tube, good convergence characteristics can be obtained.

DETAILED DESCRIPTION OF THE PREFERRED EMBODIMENT

Figure 1:
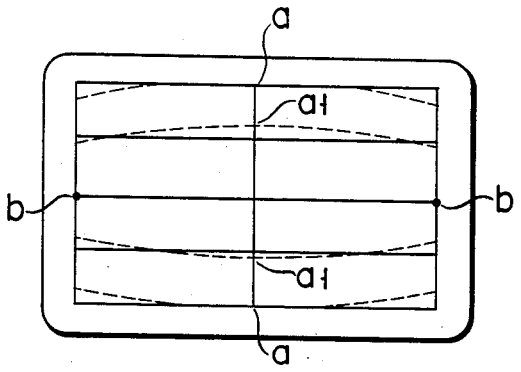
FIG. 1 is a schematic plan view showing differences between scanning lines of center beam raster and those of side beam raster in a conventional color picture tube device.
Figure 2:
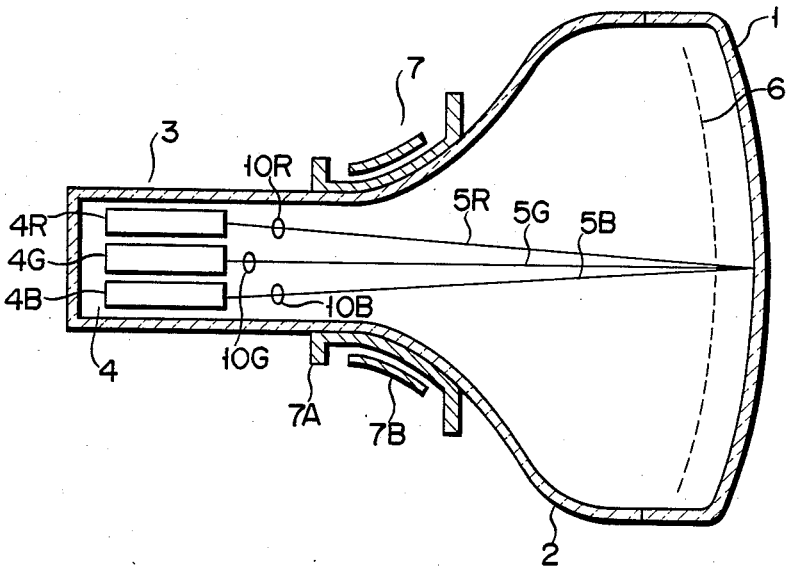
FIG. 2 is a sectional view schematically showing a color picture tube device with first and second magnetic control elements according to an embodiment of the present invention.

FIG. 2 shows a self convergence type color picture tube device according to an embodiment of the present invention. As is well known, a tube envelope of a color picture tube device is made of glass and comprises a panel section 1 serving as a substantially rectangular screen, a funnel section 2 and a neck section 3. The section 1 is integrally formed with the section 3 through the section 2. The tube envelope is held at a vacuum. An electron gun assembly 4 having three electron gun sections 4R, 4B and 4G respectively corresponding to the three primary colors, i.e., R, G and B, is received in the neck section 3. Each electron gun section comprises a heater, a control electrode, a focusing electrode and a high voltage electrode (not shown). The dose of thermoelectrons emitted from the cathode heated by the heater and reaching the screen is predetermined by the control electrode. The electron beams are focused by an electron lens constituted by the focusing electrode and the high voltage electrode so as to obtain optimal beam sizes. A shadow mask 6 with a number of regular apertures is located so as to be spaced by a predetermined distance from the inner surface of the section 1. R, G and B phosphor stripes (not shown) corresponding to the apertures of the shadow mask 6 are formed on the inner surface of the section 1 to define the screen. The three electron beams emitted from the electron gun assembly land on the corresponding phosphor stripes under the control of the shadow mask, thereby exciting predetermined phosphor stripes. A deflection yoke 7 is arranged around the sections 3 and 2 of the tube envelope. The yoke 7 comprises saddle coils 7A for generating a horizontal deflection magnetic field and a taroidal coil 7B wound around an annular magnetic permiable core in a taroidal shape so as to generate a vertical deflection magnetic field. The electron beams are deflected by the deflection magnetic fields generated by the yoke 7.

Figure 3:
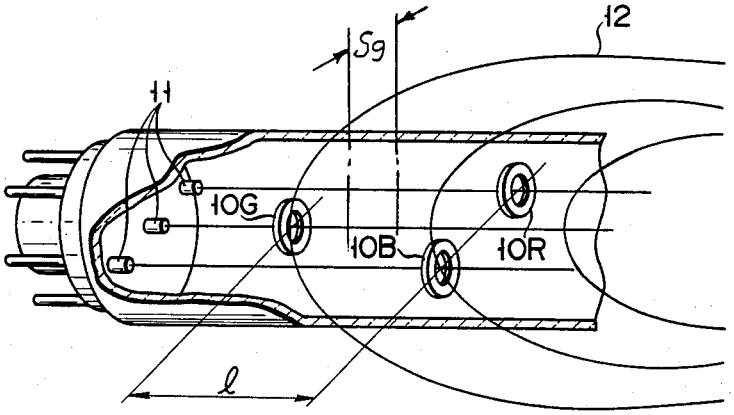
FIG. 3 is a schematic partial perspective view of the color picture tube device shown in FIG. 2.

In this embodiment, as shown in FIGS. 2 and 3, first, annular magnetic field control elements 10R and 10B of a magnetic material with a high permeability are located to surround beam paths of both side beams, respectively. Similarly, a second, annular magnetic field control element 10G of a magnetic material with a high permeability is located to surround the beam path of the center beam. The elements 10R, 10B and 10G are located between the yoke 7 and the assembly 3. The first magnetic field control elements are spaced by a predetermined distance l apart from the second magnetic field control element along the beam propagation direction. The first magnetic field control elements are located at a deflection yoke side, and the second magnetic field control element is located at a cathode 11 side. Referring to FIG. 3, reference numeral 12 denotes lines of magnetic flux leaking from the deflection yoke.

Figure 4A:
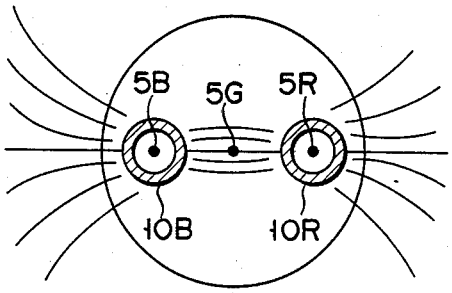
FIGS. 4A and 4B are partial plan views for explaining the effect of the first and second magnetic field control elements shown in FIG. 3.
Figure 4B:
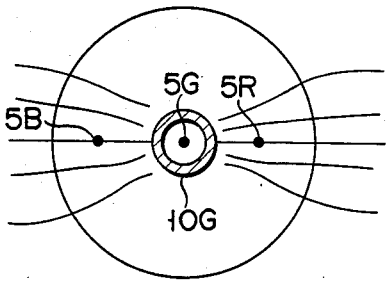

Referring to FIG. 3, the electron gun electrodes excluding the cathode are omitted. The elements 10R, 10B and 10G act on the distribution of lines of magnetic flux 12 to control the deflection sensitivity of the respective electron beams. More particularly, the elements 10R, 10B and 10G serve to concentrate the leaked magnetic field thereof and shield inner portions thereof. When a beam passes through the element, its deflection sensitivity is decreased. As shown in FIG. 4A, the first magnetic field control elements increase the deflection sensitivity of the center beam G. However, the second magnetic field control element decreases the deflection sensitivity of the center beam G, as shown in FIG. 4B. The center beam raster size is increased or decreased with respect to the raster sizes of the side beams in accordance with the increase/decrease in deflection sensitivity.

The vertical raster size of the center beam is increased by the first magnetic field control elements, and decreased by the second magnetic field control element, thereby aligning the vertical raster size of the center beam with that of the side beams and hence preventing the scanning lines of the center beam rasters from being shifted to the horizontal axis at the corners of the screen.

Figure 5A:
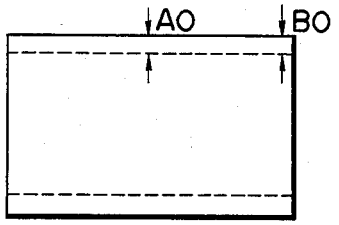
FIGS. 5A to 5C are representations for explaining correction of the raster size on the screen.

FIG. 5A shows raster size misalignment when the magnetic field control elements are not used. The side beam rasters are defined as a reference indicated by solid lines, while the center beam rasters are represented by broken lines, respectively. In the self convergence type deflection yoke, the vertical raster size of the center beam is smaller than that of the side beams. The difference between raster sizes of the center and side beams cannot be allowed in practice.

Figure 5B:
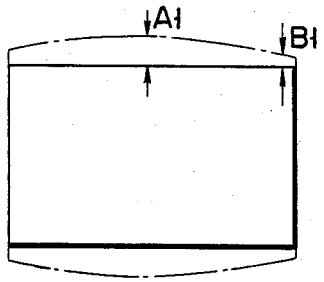

FIG. 5B shows raster sizes when only the first magnetic field control elements of the present invention are used. The center beam rasters indicated by the alternate long and short dashed line are larger than the side beam rasters. The raster size of the center beam at the center (i.e., vertical axis) of the screen is larger than that at the corner thereof.

Figure 5C:
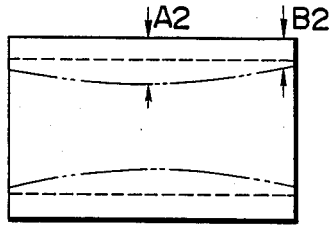

FIG. 5C shows raster sizes when only the second magnetic field control element of the present invention is used. The size of the center beam rasters indicated by the alternate long and two short dashed line is markedly smaller than that of the rasters of the side beams. The size of the center beam raster at the central portion (the vertical axis) of the screen is smaller than that at the corners. Assume that a difference between the raster sizes on the vertical axis is defined as A, and a difference thereof at the corners is defined as B. A case without magnetic field control elements is represented by an affix "0", a case with the first magnetic field control elements is represented by an affix "1", and a case with the second magnetic field control element is represented by an affix "2".

The raster correction values by the first magnetic field control elements along the V (vertical) and D (diagonal) axes are (A1+A0) and (B1+B0), respectively. The raster correction values by the second magnetic field control element along the V and D axes are (A2−A0) and (B2−B0), respectively. The present inventors have made an extensive study on the ratio of correction value along the V axis to correction value along the D axis. As a result, the following relation was obtained:

$$1>k1>k2>0$$

for $$k1=(B1+B0)/(A1+A0) \quad (1)$$

$$k2=(B2-B0)/(A2-A0) \quad (2)$$

The correction value ratio for the first magnetic field control elements is larger than that for the second magnetic field control element, but both the correction values fall within the range between 1 and 0.

In general, the correction values near the deflection yoke along the V and D axes are close to each other. However, at a position away from the deflection yoke, the correction value along the D axis is decreased, so that only the value along the V axis is corrected. The above relationship is closely associated with the position of the magnetic field control element in addition to the shape thereof. The raster sizes of the center beam are uniformly aligned with those of the side beams along the V and D axes of the screen in the following manner:

In general, A0 is substantially the same as B0.

$$A0=B0 \quad (3)$$

The raster sizes are aligned with each other on the V axes:

$$A1=A2-A0 \quad (4)$$

A difference between raster sizes at the corners can be derived from equations (1) to (4) as follows:

$$\Delta = B1 - (B2 - B0) \quad (5)$$

$$= (k1 - k2)A2 - (1 - k2)A0$$

When relation $A2=(1-k2)A0/(k1-k2)$ is established, the raster sizes can be aligned with each other even at the corners. In other words, the difference $\Delta$ becomes zero.

When a deflection yoke is designed, value AO (i.e., the difference between the raster size of the center beam and that of both side beams porduced when no magnetic field control elements are used) can be determined. Values k1 and k2, i.e., the ratios of the raster correction values, given by equations (1) and (2), respectively, can be determined by the shapes and positions of the first and second magnetic field control elements. Once AO, K1 and k2 have been obtained, value A2 (i.e., the difference between the raster size of the center beam and that of both side beams, produced when the second magnetic field control elements are used) can be determined.

The necessary correction value of the first magnetic field control elements is given as follows:

$$A1+A0=A2=(1-k2)A0/(k1-k2) \quad (6)$$

The necessary correction value of the second magnetic field control element is given as follows:

$$A2-A0=(1-k1)A0/(k1-K2) \quad (7)$$

A case will be exemplified wherein the present invention is applied to a 25 inch type color picture tube having a deflection angle of 110 degrees. In this case, A0 is 4.0 mm. The first and second magnetic field control elements are spaced about 20 mm and about 40 mm apart from the end of the deflection yoke. A distance Sg between the beams is 6.6 mm. In this case, k1 and k2 are experimentally given as follows:

$$k1=0.7$$

$$k2=0.3$$

The optimal correction values of the first and second magnetic field control elements are derived from equations (6) and (7) to be 7.0 mm and 3.0 mm, respectively. The shifted distance between the scanning point of the center beam raster at the corners and that at the center when the rasters is aligned on the V axis can be decreased from 0.8 mm to 1.0 mm (conventional) case) to 0 to 0.2 mm, thereby greatly improving the characteristics of the color picture tube.

Figure 6:
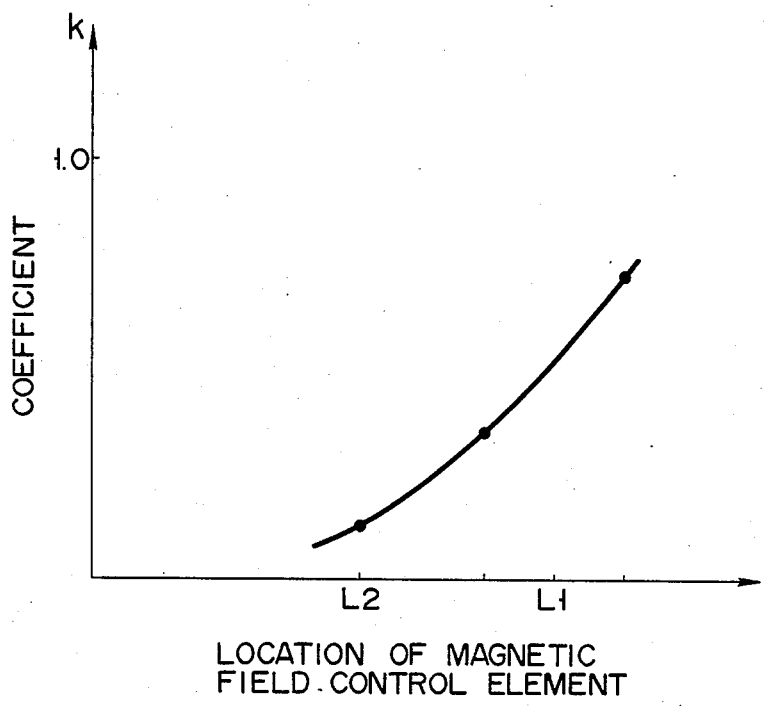
FIG. 6 is a graph showing the coefficient as a function of the location of the magnetic field control element.
Figure 7:
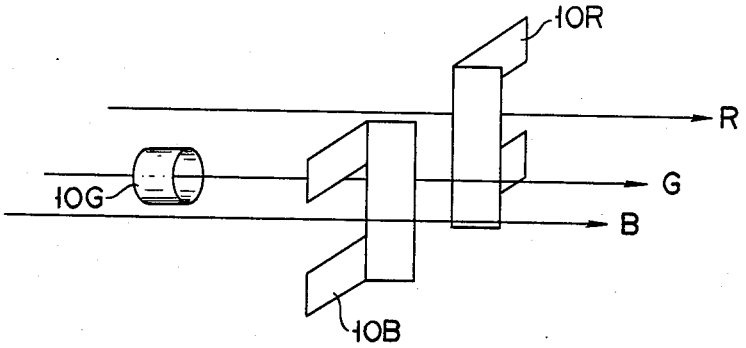
FIGS. 7, 8 and 9 are perspective views showing modifications of the first and second magnetic field control elements, respectively.

FIG. 6 is a graph showing the raster correction ratio (coefficient) k for the V and D axes as a function of the location of the first and second magnetic field control elements. When the position of the first magnetic field control elements is fixed while the position of the second magnetic field control element is variable, $k2=0.5$ is obtained when the position of the second magnetic field control element is given as L1 ($l \approx 10$ mm). The necessary correction value is 10.0 mm for the first magnetic field control elements, and the necessary correction value is 6.0 mm for the second magnetic field control element. When the first and second magnetic field control elements are positioned close to each other, the necessary correction values are rapidly increased, resulting in inconvenience.

However, when the second magnetic field control element is located at point L2 ($l \approx 40$ mm), $k2=0.1$ is obtained. The necessary correction values of the first and second magnetic field control elements are 6.0 mm and 2.0 mm, respectively. These necessary correction values are relatively small. However, even if the magnetic field near the second magnetic field control element is small, correction itself cannot be performed. Therefore, the distance l between the first and second magnetic field control elements is preferably determined by the beam distance Sg to be experimentally $6 \geqq l/Sg \geqq 1$, and preferably $l/Sg \approx 3$.

The modifications of the above embodiment will be described hereinafter.

The annular element is exemplified in the above embodiment as shown in FIG. 3. However, the magnetic control element can be cylindrical and need not be circular.

Figure 8:
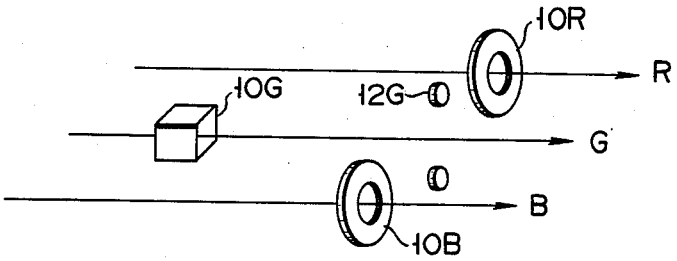
Figure 9:
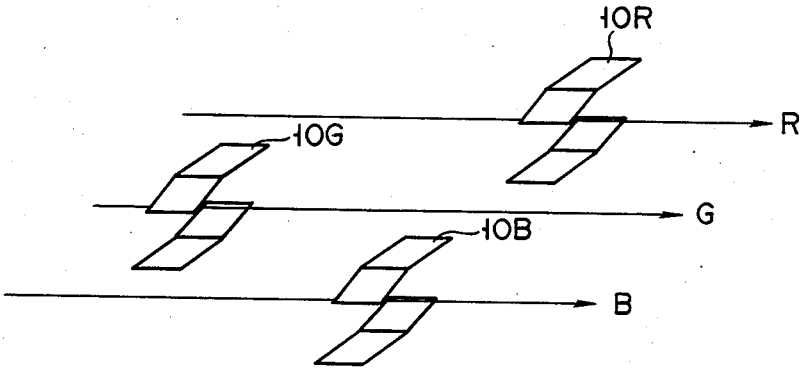

Various shapes and other combinations of the magnetic control elements are illustrated in FIGS. 8, 9 and 10.

The first magnetic control elements can comprise any shape. It is essential to provide a shape for surrounding the electron beam and to improve the sensitivity of the center beam raster upon vertical deflection. Similarly, when the second magnetic field control element is of a type wherein the sensitivity of the center beam raster is decreased, an element of any suitable shape can be used.

The first magnetic field control elements can be arranged in the convergence cup electrode at the top of the electron gun in the same manner as in the conventional assembly. The second magnetic field control element can be aranged inside the high voltage electrode, the focusing electrode, the acceleration electrode or the like. Furthermore, part of each electrode can be formed into the magnetic field control element. The present invention can be practiced even if the magnetic field control elements constitute a plurality (two or more) of stages. For example, as shown in FIG. 8, an additional magnetic field control element 12G can be located on the same plane with the first magnetic field control elements 10B and 10R in addition to the second magnetic field control element 10G.

As is apparent from the above description, in the color picture tube having the first and second magnetic field control elements, unlike the conventional device, misalignment of the center beam raster size with that of the side beam raster size, especially at the corners of the screen can be greatly improved. Furthermore, misalignment between the rasters at the intermediate portion of the screen can also be improved.

According to the present invention as described above, the convergence characteristics can be greatly improved and the resolution can be improved for a large screen and a character display.

What is claimed is:

1. A color picture tube device comprising:

a tube envelope including a neck section, a panel section and a funnel section formed between said neck section and said panel section, said tube envelope having an axis;

an in-line type electron gun having a cathode and received in said neck section, said electron gun being arranged to emit a center electron beam and two side electron beams toward said panel section;

a deflection unit which is arranged around said neck and funnel sections and which includes first deflection coil means for deflecting electron beams toward a first deflection direction defined in and parallel to a plane including the three electron beams, and second deflection coil means for deflecting the electron beams along a second deflection direction perpendicular to the first deflection direction and the plane including the three electron beams; and means for controlling a magnetic field in said neck section, located in said neck section, and made of a magnetic member with high permeability, and for substantially matching sizes of resters which are defined by the three electron beams respectively, said controlling means including first magnetic field control menns for increasing a raster size of the center electron beam at least in the second deflection direction to shape the raster of the center electron beam into a barrel shape, and second magnetic field control means for decreasing the raster size of the center electron beam relative to a raster size of the side beams to shape the raster of the center electron beam into a pin cushion shape, said first and second magnetic field control measn being located between said deflection unit and said cathode of said electron gun and being spaced by a predetermined distance from each other along the axis of said tube envelope, and the second magnetic field control means being arranged closer to the cathode than the first magnetic field control means.

2. A device according to claim 1, wherein said first magnetic field control means respectively comprise magnetic members for surrounding the side beams, and said second magnetic field control means comprises a magnetic member for surrounding the center beam.

3. A device according to claim 1, wherein the predetermined distance between said first and second magnetic field control elements and a distance Sg between the center and side beams satisfy a relationship $6>1/Sg>1$.

4. A device according to claim 1, wherein a magnetic field generated by said second deflection coil means of said deflection unit has a barrel shape as a whole.

5. A device according to claim 1, wherein said second deflection coil means of said deflection unit is wound around a magnetic permeable core in a taroidal shape.

6. A device according to claim 1, wherein a magnetic field generated by said first deflection coil means of said deflection unit has a pin cushion shape as a whole.

7. A device according to claim 1, wherein each of said first magnetic field control elements comprises a pair of plate members of a magnetic permeable material, the side beams being transmitted between said pair of plate members, and said second magnetic control element comprises a pair of plate members through which the center beam passes.

8. An apparatus as in claim 1 wherein each of said first and second magnetic field control means are annular rings with a center opening.

* * * * *